United States Patent [19]

Copeland et al.

[11] 3,937,449

[45] Feb. 10, 1976

[54] LIQUID-FUEL ATOMIZATION AND INJECTION DEVICE

[75] Inventors: William F. Copeland, Plum Borough; Charles M. Sciulli, Jr., Whitehall Borough; Donald G. White, Plum Borough, all of Pa.

[73] Assignee: United States Steel Corporation, Pittsburgh, Pa.

[22] Filed: June 26, 1974

[21] Appl. No.: 483,175

[52] U.S. Cl. ..... 266/29; 239/424.5; 239/430

[51] Int. Cl.[2] ..... F27B 1/16

[58] Field of Search ..... 239/8, 405, 406, 132.3, 239/424.5, 430, 429, 431; 266/29, 30

[56] References Cited

UNITED STATES PATENTS

| | | | |
|---|---|---|---|
| 912,500 | 2/1909 | Snyder | 239/430 |
| 1,102,329 | 7/1914 | Dunn | 239/430 |
| 1,423,650 | 7/1922 | Decur | 239/430 X |
| 1,462,680 | 7/1923 | Bliss | 239/430 X |
| 1,647,956 | 11/1927 | Butcher | 239/430 |
| 1,999,121 | 4/1935 | Wilson | 239/430 |
| 3,216,714 | 11/1965 | Eibl et al. | 239/424.5 X |
| 3,266,552 | 8/1966 | Dennis | 239/430 |

*Primary Examiner*—John J. Love

[57] ABSTRACT

Apparatus for atomizing and injecting fuel into a furnace, such as a blast furnace, in which two concentric tubes form a dual passage injection apparatus, the discharge end of the outer tube extending beyond the discharge end of the inner tube to form an atomization chamber. The central passageway conducts liquid fuel to its discharge end and the annular passageway conducts an atomizing fluid to its discharge end. A spray nozzle is mounted on the discharge end of the inner tube and has a plurality of atomizing passages inclined toward the longitudinal axis of the concentric tubes whereby the liquid fuel is atomized completely within the length of the outer tube.

6 Claims, 4 Drawing Figures

LIQUID-FUEL ATOMIZATION AND INJECTION DEVICE

This invention relates to lances for injecting atomized liquid fuel into a metallurgical furnace. More particularly, this application relates to an injection lance for injecting atomized liquid hydrocarbon fuels into the tuyeres of a blast furnace.

Recently, the high cost of metallurgical coke and its limited supply have resulted in the use of supplemental fuels being used to produce additional heat in the blast furnace. A majority of the supplemental fuels used are liquid hydrocarbons, such as oil or coal tar. Normally, an injection lance is installed through the sidewall of a furnace blowpipe a short distance behind a tuyere. The liquid fuel is injected into the hot-blast air stream and burns in the tuyere raceway within the furnace. The combustion products are mostly carbon monoxide and hydrogen.

If the injected fuel does not combust in the tuyere raceway, the fuel will crack in the furnace and form carbon soot. Supplemental fuel that does not combust in the raceway is not effective in satisfying process requirements in that neither energy of combustion nor reducing gas are generated. Some soot can be elutriated in the furnace off-gases which creates a pollution problem. Some soot can react with the slag in the furnace which creates burden movement problems.

Atomization of liquid fuels to micron-sized particles promotes complete combustion of these liquid fuels in the raceways. Improved fuel combustion permits more supplemental fuel to be injected into the blast furnace and results in reduced usage of metallurgical coke in the blast furnace process.

Heretofore, liquid fuel injection was accomplished by merely injecting fuel into the tuyere with a simple lance comprising a straight section of pipe. Almost no fuel was atomized when the straight pipe lance was employed as the fuel entered the hot-blast stream in a cylindrical pattern and did not break into a spray. In an attempt to obtain an increase in fluid fuel velocity and turbulence, Mulkey in U.S. Pat. No. 3,583,644 teaches the employment of a stainless steel ball-bearing restriction means in the fluid fuel injection nozzle. This resulted in a form of pressure atomization of the fluid fuel. However, the high pressure drop required for good pressure atomization can cause plugging of the lance since the opening of the nozzle has been greatly reduced, and coking of the fuel can occur in the lance from the heat of the surrounding hot blast.

We have invented a two-tube lance which atomizes substantially all liquid fuel prior to its injection into the tuyere raceways of a blast furnace.

It is the primary object of our invention to provide an apparatus for atomizing and injecting supplemental liquid fuels into a metallurgical furnace to reduce the amounts of primary fuel required in the metallurgical operation involved.

It is another object of our invention to provide a liquid fuel injection device for a metallurgical blast furnace, which device is not subject to plugging from the action of coking the liquid fuel flowing therethrough.

It is also an object of our invention to provide a device for atomizing liquid fuel substantially completely prior to the exit of such liquid fuel from the discharge end of the device.

It is a further object to provide a device which need not be removed during furnace backdrafting.

These and other objects will become more apparent after referring to the following specification and the appended drawings in which.

Figure 1:
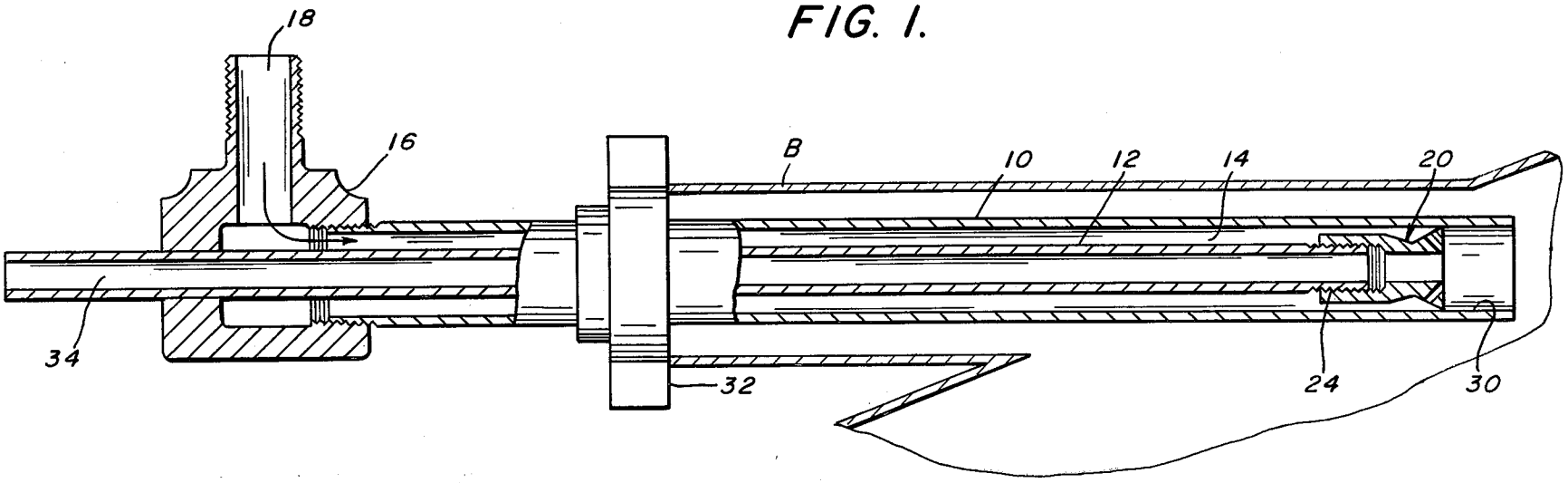
FIG. 1 is a partially sectioned side elevation view of our invented fuel atomization and injection device.
Figure 3:
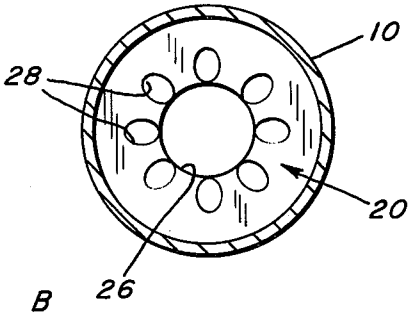
FIG. 3 is a righthand end view of the device of FIG. 1.
Figure 4:
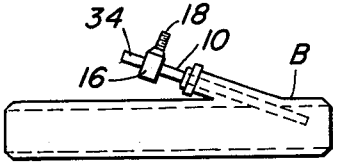
FIG. 4 is an elevational view of the fuel atomization and injection device of the present invention assembled in the hot blast pipe of a blast furnace.
Figure 2:
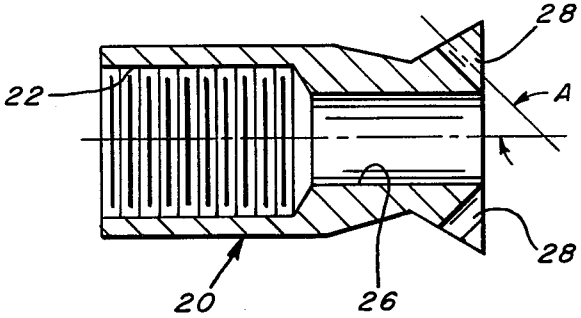
FIG. 2 is a sectional elevation view of our spray nozzle on a larger scale than FIG. 1.

Our invention, as depicted in the drawings, includes in assembly with a blast furnace blow pipe B an outer tube 10, and an inner tube 12 spaced from and substantially concentric with the outer tube to form an annular space 14 between the tubes. Tee 16 connects steam inlet 18 with annular space 14. A spray nozzle 20, best shown in FIG. 2, has interior threads 22 to receive the threaded end 24 of inner tube 12. The bore 26 of the spray nozzle is substantially identical with the internal diameter of the inner tube 12. The diameter of the discharge face of the spray nozzle is the same as the internal diameter of the outer tube 10, as shown in FIG. 3. Spray nozzle 20 contains a plurality of atomizing ports 28 in its discharge face. The port-containing portion of the spray nozzle may be a frusto-conical section. The centerline of each port intersects the longitudinal axis of the spray nozzle (and inner and outer tubes) forming an angle A therewith. The discharge end of the outer tube extends from ¼ inch to 2 inches farther than the discharge face of the spray nozzle forming an atomization chamber 30 in the end of the outer tube. The injection device when installed in a furnace normally passes through a stand-pipe seal 32.

The annular spacing between the inner tube 12 and the outer tube 10 is maintained by the relative support provided each tube by tee 16 and by the proper seating of spray nozzle 20 on the inner tube 12 and within the outer tube 10.

In operation, liquid fuel flows through the central passageway 34 of the inner tube discharging through central port 26 of spray nozzle 20. An atomizing fluid enters annular space 14 through inlet 18 and passes through atomizing ports 28 impining on the liquid fuel atomizing it within chamber 30. Inasmuch as the atomizing fluid, which is normally steam, flows in the annular passageway 14, it provides an insulating layer between the fuel and the hot-blast air of the tuyere, preventing the liquid fuel from reaching coking temperatures while flowing in the lance. This insulation quality prevents plugging of the nozzle. The lance cooling quality imparted by the steam also makes it unnecessary for the fuel injection lance to be removed from the tuyere during furnace backdrafting.

Although the angle A between the jets of atomizing fluid and the centerline of the inner tube, which is also the centerline of the liquid fuel stream exiting the inner tube 12, may vary from about 30° to about 60°, it has been found that the optimum atomizing angle A is 45°.

The atomization chamber 30 may vary from ¼ inch to 2 inches in length. The optimum chamber length appears to be about ½ inch to obtain the proper fuel flow rate.

Good fuel atomization is achieved when our invented apparatus is operated at a ratio of atomizing fluid to fuel equal to or greater than one pound per gallon. This fluid to fuel ratio gives a velocity ratio of at least 35 to 1. The atomizing fluid velocity can vary from 20 to 50 times that of the fuel velocity. the atomizing fluid velocity is determined as it exits the atomizing port 28. Although increased fuel atomization is obtained as the atomizing fluid to liquid fuel velocity ratio is increased, the velocity ratio cannot exceed forty, or the injection plume will impinge on the opposite sides of the blowpipe and the tuyere. If it comes into contact with the water-cooled tuyere, it can coalesce and run out of the furnace between the tuyere and the tuyere cooler. Also, the fuel will accumulate in the tuyere which results in its blockage.

It is readily apparent from the above that we have invented an apparatus for atomizing and injecting liquid fuel into a furnace which achieves better liquid fuel atomization than devices used heretofore; which apparatus is not subject to plugging; and which apparatus atomizes liquid fuel substantially completely prior to discharging the fuel into a metallurgical furnace.

We claim:

1. A liquid fuel injector for atomizing liquid fuel prior to admixture with hot air introduced into a blast furnace through a hot blast pipe, said apparatus comprising:

a. a cylindrical outer tube penetrating said hot blast pipe with its discharge end in open communication with the interior of said pipe;

b. an inner tube concentrically disposed in said outer tube in spaced relation from the wall thereof;

c. said outer and inner tubes cooperating to define concentric axial and annular passages through said apparatus;

d. a spray nozzle attached to the discharge end of said inner tube and having an outer peripheral edge contiguous with the inner surface of said outer tube to separate said annular passage from said axial passage;

e. said spray nozzle being axially spaced from the discharge end of said outer tube to define a cylindrical atomization chamber adjacent thereto;

f. a cylindrical axial opening through said nozzle connecting said axial passage with said atomization chamber;

g. a plurality of circumferentially spaced atomizing openings through said nozzle in radially spaced relation to said axial opening, said atomizing openings connecting said annular passage with said atomization chamber;

h. means for supplying liquid fuel to said axial passage, and i. means for supplying atomizing fluid to said annular passage.

2. Apparatus according to claim 1 in which said atomizing openings are inclined with respect to the longitudinal axis of said axial opening at an angle of between 30° and 60°.

3. Apparatus according to claim 2 wherein said angle is 45°.

4. Apparatus according to claim 1 in which said atomization chamber is from ¼ inch to 2 inches in longitudinal extent.

5. Apparatus according to claim 4 wherein the length of said atomization chamber is about ½ inch.

6. Apparatus according to claim 1 in which said atomizing fluid is steam.

* * * * *